US008454759B2

(12) United States Patent
Selsvik

(10) Patent No.: US 8,454,759 B2
(45) Date of Patent: Jun. 4, 2013

(54) SCREEN WASH MACHINE

(75) Inventor: Kjell Rune Selsvik, Herand (NO)

(73) Assignee: M-I L.L.C., Houston, TX (US)

( * ) Notice: Subject to any disclaimer, the term of this patent is extended or adjusted under 35 U.S.C. 154(b) by 384 days.

(21) Appl. No.: 12/602,895

(22) PCT Filed: Jun. 4, 2008

(86) PCT No.: PCT/IB2008/001420

§ 371 (c)(1),
(2), (4) Date: Jun. 21, 2010

(87) PCT Pub. No.: WO2008/149200

PCT Pub. Date: Dec. 11, 2008

(65) Prior Publication Data

US 2010/0288304 A1 Nov. 18, 2010

(30) Foreign Application Priority Data

Jun. 5, 2007 (NO) ..... 20072869

(51) Int. Cl.

| | |
|---|---|
| ***B08B 1/00*** | (2006.01) |
| ***B08B 3/02*** | (2006.01) |
| ***B08B 3/04*** | (2006.01) |

(52) U.S. Cl.

USPC ..... 134/32; 134/172; 134/177; 134/200; 134/196; 134/197; 134/199

(58) Field of Classification Search

USPC ..... 134/172, 177, 196, 197, 198, 199, 134/200; 239/225.1

See application file for complete search history.

(56) References Cited

U.S. PATENT DOCUMENTS

| | | | | |
|---|---|---|---|---|
| 2,682,676 | A * | 7/1954 | Franchi | 15/77 |
| 3,656,493 | A * | 4/1972 | Black et al. | 134/113 |
| 3,760,824 | A | 9/1973 | Edwards et al. | |
| 4,030,513 | A * | 6/1977 | McKenzie | 134/167 R |
| 4,107,042 | A * | 8/1978 | Heinrich et al. | 210/225 |
| 5,056,948 | A | 10/1991 | Puder et al. | |
| 5,513,666 | A * | 5/1996 | Fujiwara | 134/68 |
| 5,860,361 | A | 1/1999 | Nanjyo et al. | |
| 6,102,054 | A | 8/2000 | Diaz | |
| 6,579,381 | B1 | 6/2003 | Moscatelli | |

FOREIGN PATENT DOCUMENTS

| | | |
|---|---|---|
| JP | 10189528 A | 7/1998 |
| JP | 24230865 A | 8/2004 |

* cited by examiner

*Primary Examiner* — Michael Kornakov
*Assistant Examiner* — Natasha Campbell
(74) *Attorney, Agent, or Firm* — Osha Liang LLP

(57) ABSTRACT

Washing machine for screen that includes a closed washing chamber having internal nozzles for cleaning the screen. The nozzles are provided on a flushing frame enclosing the screen, and the flushing frame may be moved upwards and downwards within the chamber whereby the screen is flushed and cleaned. A method for cleaning the screen in the washing machine is also described.

20 Claims, 2 Drawing Sheets

SCREEN WASH MACHINE

CROSS-REFERENCE TO RELATED APPLICATIONS

This application is a 35 U.S. C. §371 national stage application of PCT Application No. PCT/IB2008/001420, filed 4 Jun. 2008, and entitled Screen Wash Machine Trailer, hereby incorporated herein by reference, which claims priority to Norwegian Patent Application No. 2007 2869, filed 5 Jun. 2007, hereby incorporated herein by reference.

STATEMENT REGARDING FEDERALLY-SPONSORED RESEARCH OR DEVELOPMENT

Not applicable.

BACKGROUND

The present invention concerns a washing machine for screen, comprising: a closed washing chamber having internal nozzles for cleaning the screen. The invention further concerns a method for cleaning a screen in a closed washing machine comprising a closable inlet opening/door and a washing chamber having internal nozzles for flushing the screen.

U.S. Pat. No. 5,056,948 describes a flushing chamber having rotatable nozzles flushing on both sides of an object to be cleaned. U.S. Pat. No. 5,860,361 concerns a flushing chamber having nozzles on both sides of a vertical grid which can be moved vertically in the chamber during the process.

U.S. Pat. No. 3,656,493 concerns a chamber where a nozzle during flushing of a stencil grid can be moved upwards and downwards or horizontally.

U.S. Pat. No. 3,760,824 concerns a plate washer where the plate is moved between a two-sided nozzle system.

U.S. Pat. No. 6,102,054 concerns a washing chamber having stationary pipe system which cleans a stationary plate.

JP 10189528 deals with a chamber having two-sided flushing of a plate shaped object which is moved vertically. JP 24230865 concerns a washing chamber having rotatable nozzles flushing towards all sides of a stationary grid.

U.S. Pat. No. 6,579,381 concerns a washing chamber where a vertically located "silk screen" is one-sided flushed by nozzles located on a horizontal bar which can be moved upwards and downwards. Screens mounted on frames are used more and more in the drilling industry and different forms and dimensions are found, but common for all of these is that they often are replaced during drilling and that they are dirty and difficult to work with. Today the screens are often put up on a wall or like and flushed by means of the flushing lance of a high pressure washer. These frames have so many "nooks and corners" that mud and cuttings are thrown in all directions during the cleaning, resulting in that the one washing, in addition to the premises, are littered.

SUMMARY

Embodiments of the present invention provide a washing machine for screen which can be used on all rigs offshore and onshore plants without in substantial degree have to revise any of the components of the machine.

Embodiments may also include that the machine shall be water tight, such that splash of water, water vapour (steam), cuttings and mud remain within the cabinet.

Embodiments may also include that the machine shall be ergonomical and easy to use and it shall satisfy existing safety requirements and authorisations. Embodiments may also include that the washing machine shall clean the screen in an effective and economical way and simultaneously provide a good working environment.

Embodiments may also include a washing machine as stated in the preamble of the description and which is characterized in that the nozzles are provided on a flushing frame enclosing the screens and the flushing frame may be moved upwards and downwards within the chamber whereby the screen is flushed and cleaned.

Embodiments also include a method for cleaning a screen as stated in the preamble of the description and which further are characterized in that the screen is guided horizontally into the washing chamber over a scraping off pipe in the inlet opening, whereby mud and cuttings on the underside of the screen are scraped off, the screen is pushed into guides in the lower part of the washing chamber and raised towards vertical position and suspended in the gripping devices in an upper part of the washing chamber, the inlet opening is closed and the washing machine can be activated whereby a sealing gasket for the door is activated and water is transported from a ring pipe towards the inner walls of the chamber in addition to that high pressure- and low pressure water are flushed out of the nozzles of the flushing frame and the flushing frame, which encloses the screen and which is provided on a movable cylinder, is moved upwards and downwards within the chamber whereby the screen is cleaned.

BRIEF DESCRIPTION OF THE DRAWINGS

Below a washing machine for screen and method for cleaning the screen are explained with the reference to the figures, where.

DETAILED DESCRIPTION OF EMBODIMENTS

Figure 1:
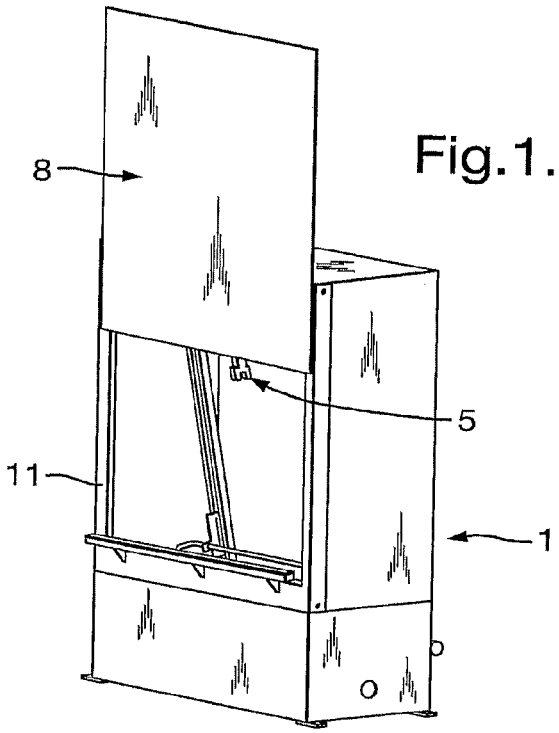
FIG. 1 shows the washing machine having a closable inlet opening/door in open position.
Figure 4:
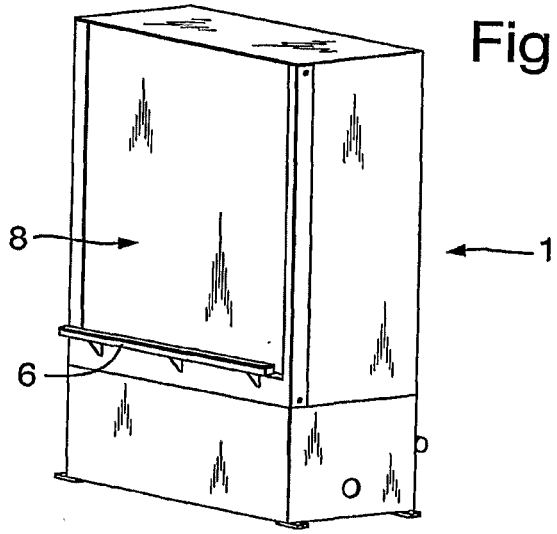
FIG. 4 shows the complete washing machine in an operational condition where the inlet opening/door is closed.

First with reference to FIGS. 1 and 4 an embodiment of a washing machine 1 according to the invention is shown. FIG. 1 shows the washing machine 1 with inlet opening/door 8 in open position, i.e. the door 8 is pushed vertically downwards. Thus, an internal chamber 11 is shown with an approximately vertical provided screen S. FIG. 4 shows the washing chamber 11 in closed position i.e. the door 8 is moved downwards and the washing machine 1 is in a condition to carry out a washing operation.

Figure 2:
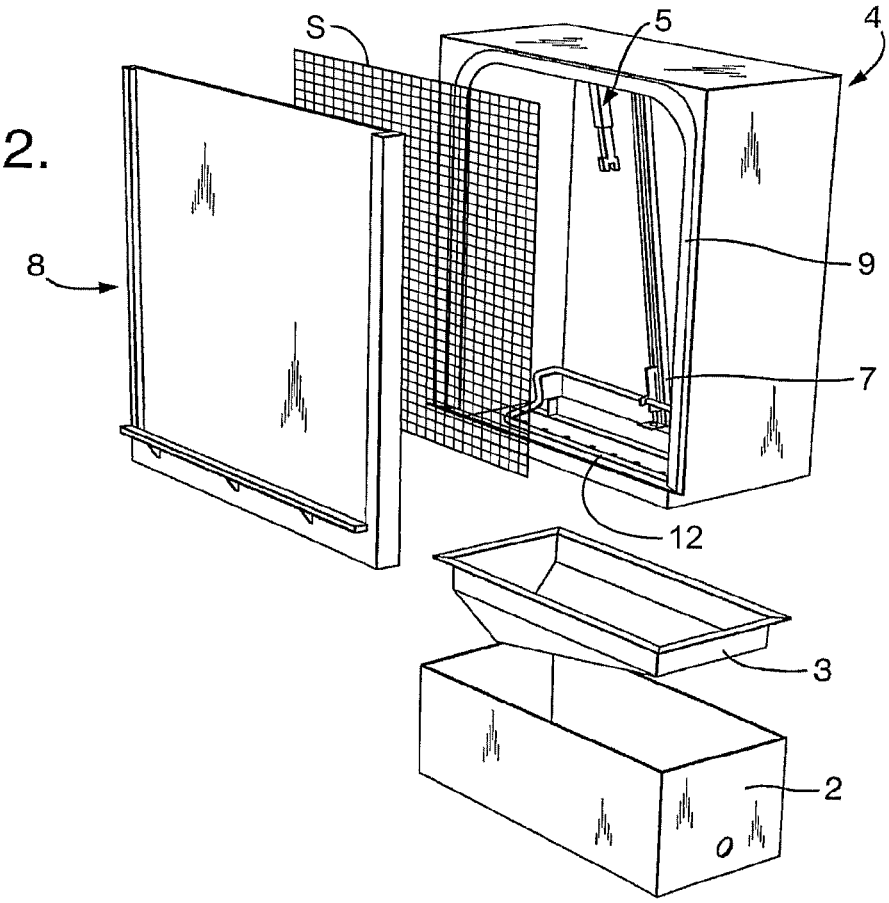
FIG. 2 shows the main parts of the machine in a separated condition.
Figure 3:
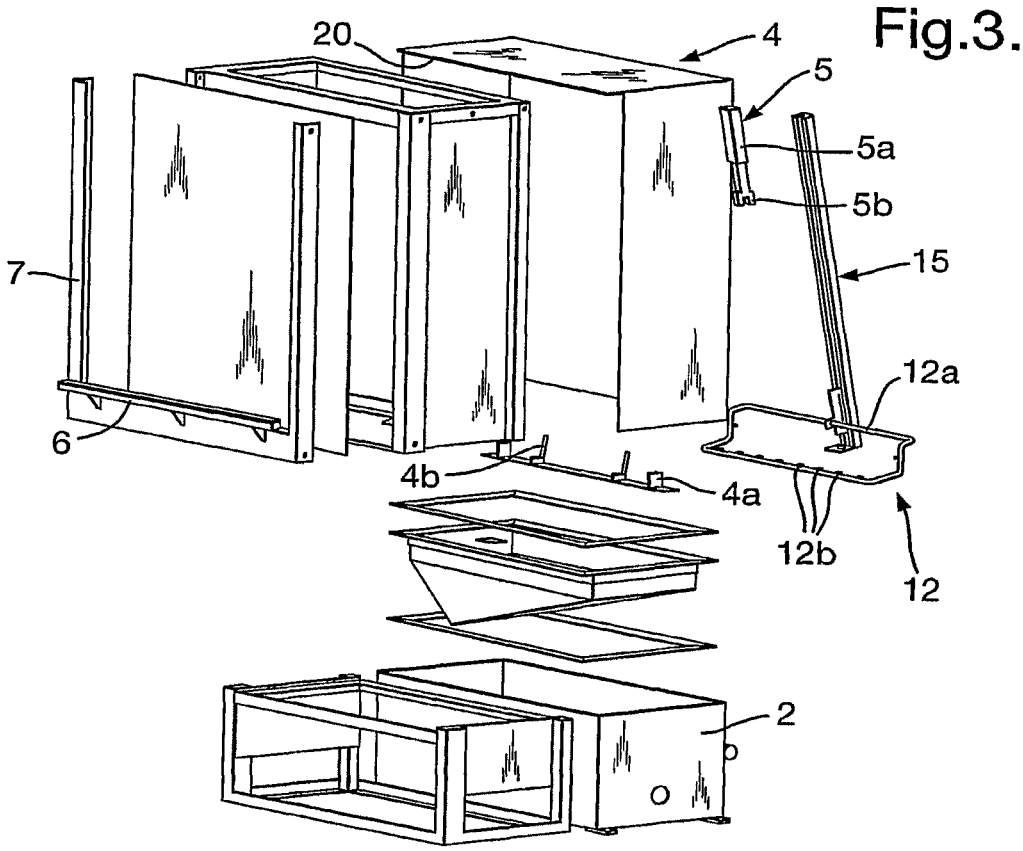
FIG. 3 is a further detailed depiction of the main parts of the washing machine according to FIGS. 2.

With reference to FIGS. 2 and 3 the main parts of the washing machine 1 are shown, and these are basically: a bottom box 2, a trough 3, a top box 4 and the door 8. The mentioned main parts in an assembled condition will form an internal washing chamber 11. The internal washing chamber 11 is further provided with a flushing frame 12 which can be moved upwards and downwards within the chamber 11. The flushing frame 12 is provided on a lifting- and lowering device 15 which in the shown embodiment is a cylinder without piston. The flushing frame 12 has a rectangular ring form and is provided with nozzles 12*a*, 12*b* for preferably high- and low pressure water. In the shown embodiment the nozzles 12*a* for high pressure water are provided in the rear area of the flushing frame whereby the flushing nozzles are forwardly directed towards the door 8 of the chamber. The nozzles 12*b* for low pressure water are provided on the front area of the flushing frame and are directed towards the rear area of the chamber. Thus, the flushing frame 12 is formed such that it will enclose the screen S, whereby the stationary screen S is flushed with high pressure water on the rear side and with low pressure water on the front side since the flushing frame 12 with continuous movement moves upwards and downwards within the chamber 11 and the enclosing screen S, respectively. The washing chamber 11 is in its lower part provided with guides 4*a*, 4*b* for the screen S. Gripping devices 5 are further provided in the upper part of the washing chamber 11 such that the screen S is supported in vertical position and suspended in the gripping devices 5. The guides 4*a*, 4*b* and the gripping devices 5 are provided such that the screen S has an angle of inclination 0° in relation to the vertical when it is fixed. The reason for this is that the water, mud and cuttings shall not be left on small stiffening ribs of the screen S. In order to prevent that mud residues etc. are fixed to the walls of the chamber or the trough 3 a low pressure ring pipe 20 is provided in the upper part of the top box 4. This ring pipe (conduit) 20 has the following functions: nozzles flush water onto the wall surfaces in the chamber in order to prevent accumulation of mud and cuttings, and shall also speed up the removal of the waste out of the washing machine 1. The latter is due to too small water flow from the high pressure flushing water. The chamber 11 is in its lower area for entering the screen S provided with a scraping off pipe 6. The screen S is introduced horizontally into the washing chamber 11 above the scraping off pipe 6 whereby mud and cuttings on the underside of the screen S are scraped off.

Guides 4*a*, 4*b* fix the screen S in the lower edge and gripping device 5*b* maintains the screen S in the upper edge. The gripping devices 5*b* are spring loaded and are provided with an adjustable hole device 5*a* which makes the washing machine 1 able to handle all types of screens S, i.e. screens with different height and width.

The washing machine 1 will preferably be delivered with three types of troughs 3 which are located in the bottom box 2. A first embodiment of the trough will be constructed symmetrical and may be located in both directions (waste flows out of a two-inch pipe to the right or to the left). Further, it will be an embodiment of the trough 3 where the waste flows out in the rear or straight down.

The washing machine 1 will preferably be provided with a control panel which can be located on both sides of the top box 4, i.e., connections are possible on both sides. The side which is not used is blinded. The control panel has start, stop switch and speed control for water and cylinder, located on the outside, in addition to possible connections for the interface components. The control panel will include pneumatic logic- and control valves which is the "brain" itself for the washing process. Connection source will preferably be pressurised air (6-10 bar, the pressure which is available on the particular rig), fresh water (5-15 bar, the pressure which is available on the particular rig), high pressure flushing water (about 210 bar and 40 l/min, which is available on the particular rig), eventually electronic voltage (volt, pneumatic control components can be replaced by electrical components) and outlet, 2 inches "hose tail" (pipe which a hose is pressed on the outside and fixed with a hose clamp). When constructing the washing machine 1 the bottom box 2 will be the first unit to be installed. This will be fixed (screwed on) to the deck, bulkhead or railing where after a gasket is placed on the top flange. Thereafter, the trough 3 is located in the bottom box 2 whereby a gasket is placed on the top flange. The top box 4 is placed on the bottom box 2 and the trough 3, and bolted together. The top box 4 again consists of several parts as the inlet opening/door 8 which travels in a TEFLON rail 9 and which further consists of a plate and cassette which is weight balanced by weight. A wire is fixed in the lower part of the door 8 and is routed above two sheaves and to a weight. The weight has its own travelling box and is protected from the "dirty environment" within the top box 4. In order to provide a water tight washing machine, and that water vapour from the high pressure nozzles, water, cuttings and mud do not escape from the washing machine 1, an inflatable gasket 7 is used which seals against the door 8 from the inside.

The washing machine 1 functions in the following way:

Open the door/hatch 8 manually by pushing downwards.

A pneumatic sensor valve will then be activated and the machine 1 is in emergency shut down mode.

Dirty screen S is introduced horizontally with the screen side up. By introducing it over the scraping off pipe 6 which scrapes off mud and cuttings from the underside of the screen S. The waste flows into the washing machine 1. The screen S is pushed into the guides 4*a*, 4*b* in the bottom and erected towards vertical position. In order for the screen S to be fixed in the machine it must be pressed the last distance in order for the gripping device 5*b* to function.

Shut the door/hatch 8 completely.

The pneumatic sensor valve activates the machine 1 to starting mode.

Press the starting switch.

The gasket 7 is inflated, and when the pressure is stabilised the pneumatic logic valve will open for the following valves. Water starts to flow along walls from the ring pipe 20. High pressure- and low pressure water are flushed out of the pipe frame 12 which is connected to a lifting and a lowering device/cylinder 15. Cylinder 15 moves upwards in vertical direction while washing the screen S. When the cylinder 15 reaches maximum stroke the pressure will stabilise and a logic valve turn the process such as it goes down again with the same speed. On the outside of the control panel a speed regulator for adjusting the speed of the cylinder 15 is provided. This is desirable since screens S, which have stood still for a while before they are washed, are more difficult to clean. The speed of the cylinder may then be adjusted by experience depending on how dry the mud and cuttings are.

The door/hatch 8 is opened and the screen S is inspected. If it is still dirty, the door/hatch is closed and the start button is pushed.

If it is clean the screen S is removed.

The invention claimed is:

1. A washing machine for a screen, comprising:

a closed washing chamber;

a flushing frame enclosing the screen and moveable upwards and downwards within the chamber; and internal nozzles provided on the flushing frame and capable of flushing and cleaning the screen, the washing machine configured to receive the screen in a horizontal position and raise the screen to a vertical position.

2. The washing machine according to claim 1, where the flushing frame is provided on a lifting and lowering device provided within the chamber.

3. The washing machine according to claim 2, where the lifting and lowering device is a cylinder without piston capable of relocating the flushing frame in a vertical direction.

4. The washing machine according to claim 3, where the flushing frame is coupled to a pressure flushing system.

5. The washing machine according to claim 1, characterized in that the flushing frame is provided with nozzles for, high- and low pressure water.

6. The washing machine according to claim 1, the chamber further comprising a low pressure ring pipe in the chamber's upper internal area whereby water is flushed onto the chamber's internal wall faces.

7. The washing machine according to claim 1, where the chamber further comprises guides for the screen in the chamber's lower area.

8. The washing machine according to claim 7, the chamber further comprising gripping devices for the screen in the chamber's upper area.

9. A washing machine for a screen, comprising:

a closed washing chamber;

a flushing frame enclosing the screen and moveable upwards and downwards within the chamber; and internal nozzles provided on the flushing frame and capable of flushing and cleaning the screen wherein a lower area of the chamber further comprises a scraping off pipe below the screen.

10. Method for cleaning a screen in a closed washing machine comprising a closable inlet opening and a washing chamber comprising internal nozzles for flushing the screen; the method comprising:

guiding the screen horizontally into the washing chamber over a scraping off pipe in the inlet opening, whereby mud and cuttings on the underside of the screen are scraped off;

pushing the screen into guides in the lower part of the washing chamber and raising the screen towards a vertical position and suspended in gripping devices in the upper part of the washing chamber;

closing the inlet opening;

activating the washing machine whereby a sealing gasket for the door is activated and water is transported from a ring pipe towards the inner walls of the chamber in addition to high pressure and low pressure water that are flushed out of the nozzles of the flushing frame; and moving the flushing frame, which encloses the screen and which is provided on a movable, upwards and downwards within the chamber whereby the screen is cleaned.

11. The method of claim 10, further comprising activating a pneumatic sensor shut off valve by opening the inlet opening.

12. The method of claim 10, further comprising adjusting a speed of the flushing frame.

13. The method of claim 10, further comprising removing a cleaned screen from the inlet opening.

14. The method of claim 10, further comprising adjusting a pressure of the water.

15. The washing machine of claim 1, further comprising a control panel.

16. The washing machine of claim 15, wherein the control panel comprises pneumatic logic and control valves.

17. The washing machine of claim 1, further comprising a pneumatic sensor shut off valve.

18. The washing machine of claim 9, further comprising a trough.

19. The washing machine of claim 18, further comprising a ring pipe disposed in an upper part of a box.

20. The washing machine of claim 9, further comprising gripping devices for supporting the screen in a vertical position.

* * * * *